US005920956A

United States Patent [19]

Salice

[11] Patent Number: 5,920,956

[45] Date of Patent: Jul. 13, 1999

[54] SUPPORT FOR A CLOSING ELEMENT, PREFERENTIALLY FOR A DOOR LEAF OF A FOLDING/SLIDING DOOR

[75] Inventor: Luciano Salice, Carimate, Italy

[73] Assignee: Arturo Salice S.p.A., Novedrate, Italy

[21] Appl. No.: 08/800,242

[22] Filed: Feb. 12, 1997

[30] Foreign Application Priority Data

Feb. 12, 1996 [DE] Germany ..... 296 02 424 U

[51] Int. Cl.[6] ..... E05D 15/04; E05D 15/26

[52] U.S. Cl. ..... 16/87 R; 16/93 R; 16/95 R; 49/409; 160/201; 160/199; 160/206; 160/213

[58] Field of Search ..... 16/87 R, 88, 89, 16/93 R, 95 R, 95 D, 97, 104; 49/409; 160/199, 201, 206, 213

[56] References Cited

U.S. PATENT DOCUMENTS

| | | | |
|---|---|---|---|
| 2,503,848 | 4/1950 | Smith, Jr. | 16/104 |
| 2,842,795 | 7/1958 | Majeske | 16/93 R |
| 3,591,984 | 7/1971 | Lauterbach | 16/87 R |
| 4,152,872 | 5/1979 | Tanizaki et al. | 16/97 |
| 4,240,178 | 12/1980 | Miki | 16/93 D |
| 5,518,058 | 5/1996 | Gastmann | 16/93 D |
| 5,538,064 | 7/1996 | Salice | 16/91 |

FOREIGN PATENT DOCUMENTS

| | | | |
|---|---|---|---|
| 251798 | 1/1967 | Austria | 16/93 D |
| 1270755 | 6/1968 | Germany | 16/93 R |
| 1575208 | 1/1970 | Germany | 16/95 R |
| 1960037 | 12/1971 | Germany | 49/409 |
| 1759934 | 1/1972 | Germany . | |
| 9002913 | 9/1990 | Germany . | |
| 4324340 | 1/1995 | Germany . | |
| 53-84339 | 7/1978 | Japan | 49/409 |
| 1214268 | 12/1970 | United Kingdom | 16/97 |

*Primary Examiner*—Chuck Y. Mah
*Assistant Examiner*—Donald M. Gurley
*Attorney, Agent, or Firm*—Jacobson, Price, Holman & Stern, PLLC

[57] ABSTRACT

For mounting a folding/sliding door, a support is connected to a hinge arm of a hinger mounted in the upper outer end area of an outer door leaf in a position in which the side of the retaining part that attaches to the hinge arm is located in the extension of the bearing part. The folding/sliding door can then be joined by its inner leaf via hinges, preferentially standard double-link hinges, to a side panel of the body. The pre-fitted support, already connected to the hinge arm of the outer door leaf, can then be introduced and locked into the guide channel together with its carriage part. First, the carriage part is swiveled through 90 degrees around the retaining part so as to position the carriage part within the longitudinal slot of the guide channel. The carriage part is then locked in place by turning the hammer-shaped head through 90 degrees by means of its supporting pin.

10 Claims, 4 Drawing Sheets

SUPPORT FOR A CLOSING ELEMENT, PREFERENTIALLY FOR A DOOR LEAF OF A FOLDING/SLIDING DOOR

BACKGROUND OF THE INVENTION

1. Field of the Invention

The present invention relates to a support for a folding/sliding door. More particularly, the present invention relates to a support for securing a door to a channel, in which the support folds down to the side of the door during installation and has a rotating head that locks into the channel.

2. Description of the Related Art

A support of this general kind is shown, for instance, in DE-43 24 340 A1. In order to mount this known support in the upper area of the opening side of a two-leaf folding/sliding door and to introduce the support into the guide channel mounted, for example, on the facing of a wardrobe body parallel to the opening side, it is necessary to attach the hinge arm of the hinge mounted on the door leaf to the retaining part, then push the carriage part within the longitudinal slot of the guide channel and lock it there by turning the pin through 90 degrees, before the other door leaf can be flexibly connected to a side wall of the body. For this, it is necessary for the fitter to support the two-leaf door while inserting and locking the support in the guide channel, thus rendering the mounting operation significantly more complicated, because the door leaves, on larger wardrobes in particular, may be of substantial weight, and because the fitter must hold the door leaves in correct position for insertion of the support into the guide channel while carrying out the mounting with one hand. In the case of the known support, it is not possible to connect one door leaf flexibly to a side panel of the wardrobe body prior to inserting and locking the support in the guide channel, because when such a connection has been made, the necessary movement for mounting of the support in vertical direction is no longer possible. Connection of the folding/sliding door to a side panel of the wardrobe body prior to mounting of the support in the guide channel attached to the facing is, however, desirable because then the fitter no longer has to support the weight of the door while mounting the support.

SUMMARY OF THE INVENTION

The object of the invention is therefore to create a support of the kind indicated above, which can be easily inserted and locked into a guide channel and especially a support that can be inserted and locked into a guide channel after being pre-fitted to one door leaf when the folding/sliding door is already flexibly connected by one leaf to a side panel of a body.

This object is achieved in accordance with the invention, in a support of the kind indicated above, in that the carriage part is fitted with a bearing part penetrating a longitudinal slot, in which a retaining part is borne rotatable around an axis running traverse to the carriage part.

The invention relates to a support for a door leaf of a folding/sliding door, comprising a longitudinal carriage part which, as a locking mechanism, is fitted in its center area in a C-shaped guide channel with a hammer-shaped head. The head is fixed by a pin to be rotatable around an axis perpendicular to the guide channel. The width of the head is less than, and its length greater than, the width of the longitudinal slot formed between the angled webs between the arms of the guide channel. The support further comprises a retaining part connected to the carriage part for attachment of a fitting part carrying the closing element, preferentially a hinge arm.

For mounting a folding/sliding door, the support, in accordance with the invention, is connected to a hinge arm of a hinge mounted in the upper outer end area of an outer door leaf in a position in which the side of the retaining part that attaches to the hinge arm is located in the extension of the bearing part. That is, the side of the retaining part serving to attach the support to the hinge arm is located opposite the carriage part, and runs transverse to it. The folding/sliding door can then be joined by its inner leaf via hinges, preferentially standard double-link hinges, to a side panel of the body. After connection of the inner leaf of the folding/sliding door to a side panel of the body, the pre-fitted support, already connected to the hinge arm of the outer door leaf, can be introduced and locked into the guide channel together with its carriage part. First, the carriage part is swiveled through 90 degrees around the retaining part so as to position the carriage part within the longitudinal slot of the guide channel. After being engaged in the guide channel, the carriage part is then locked in place by turning the hammer-shaped head through 90 degrees by means of its supporting pin. The support thus significantly facilitates mounting of the folding/sliding door, since the door can be first fitted by its inner leaf to a side panel of the body, by way of the relevant hinges, before the pre-fitted support is introduced and locked into the facing-side guide channel. The fitter thus no longer needs to support the entire door and hold it in position in order to introduce and lock the carriage part of the support in the guide channel.

The bearing part most suitably comprises a bearing fork, in the arms of which the retaining part is borne rotatably.

The retaining part is most suitably designed to be rotatable through 90 degrees between positions at which the side of the retaining part serving to attach the hinge arm or the like is located, firstly, in the extension of the bearing arms, and secondly, to the side of said arms.

In a further form of the invention, the faces of the arms of the bearing form are shaped as rounded curves with detent recesses or detent projections, which interact with complementary detent elements of the retaining part. The interacting elements are thereby arranged such that the retaining part is engaged in the bearing fork at its end positions; that is, at one position at which the retaining part is pre-fitted to the outer door leaf, and at another position at which the carriage part flexibly connected to the retaining part is swiveled into the guide channel.

In a further form of the invention, the pin is arranged in a hole emerging in the center of the web part of the bearing fork and is fitted with an angled actuating part. The retaining part is also fitted on its side opposite the side serving to attach the hinge arm with recesses which permit the retaining part to be swiveled and, at the swivel position of the retaining part at which the side serving to attach the hinge arm is located to the side of the bearing arms, permit the pin to be turned by the angled actuating part.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

An embodiment of the invention is presented in more detail in the following, based on the drawings. The drawings show.

DETAILED DESCRIPTION OF THE PREFERRED EMBODIMENTS

Figure 1:
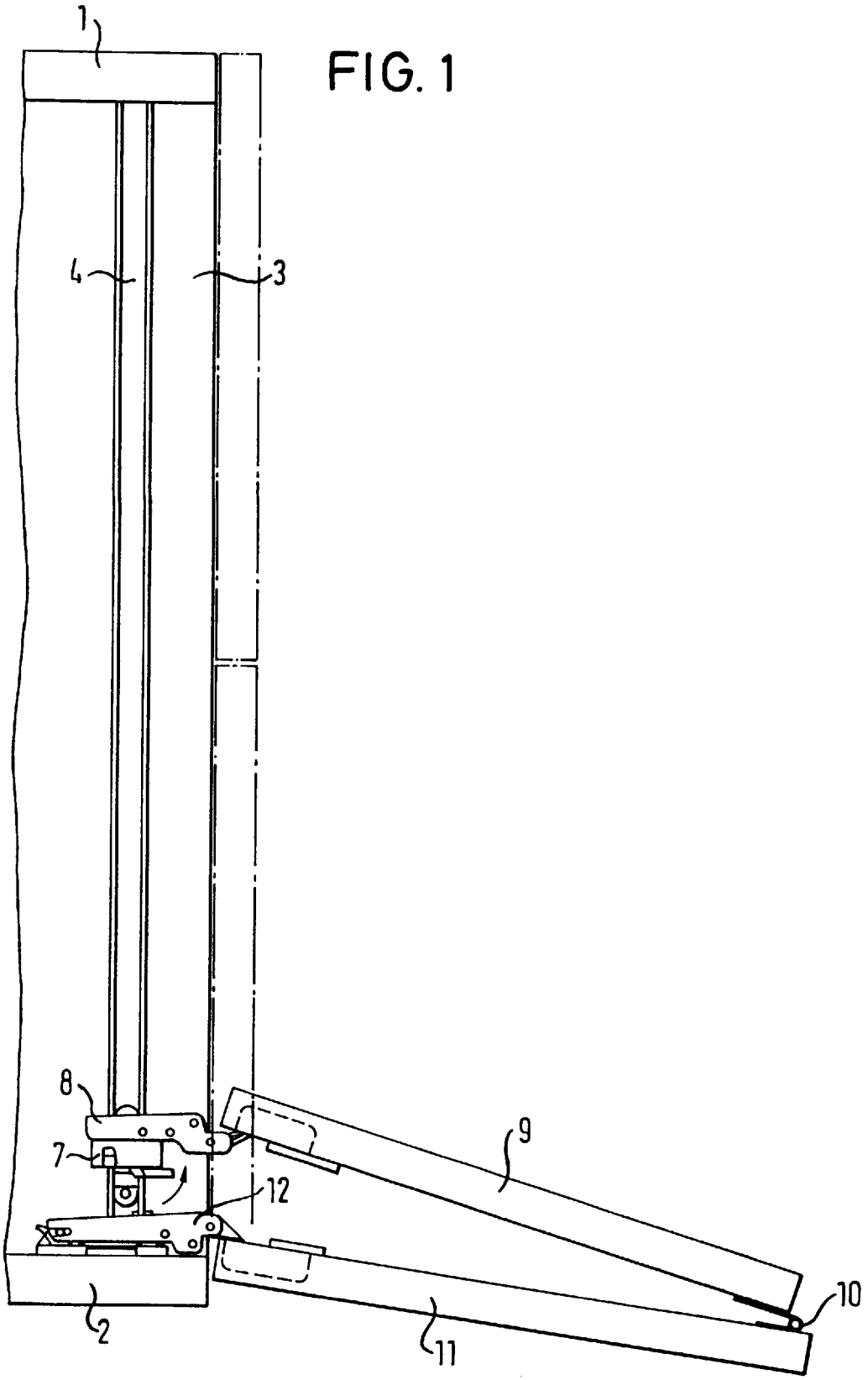
FIG. 1 is a bottom view of a folding/sliding door after removal of a furniture floor plate, in unbroken lines in open position, and in dashed/dotted lines in closed position.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 shows a bottom view of a piece of furniture having a folding/sliding door after removal of the floor plate, so that only the side panels 1, 2 and the facing panel 3 of the body are visible. On the facing panel 3, parallel to its side edge bordering the opening, a guide channel 4 is attached which has a U-shaped profile, the arms of which are angled into inward-pointing webs, such that the profile shape is designated as C-shaped for the sake of simplicity.

In the profile channel 4, the carriage part 6 of a support 5 is guided longitudinally and is joined to a retaining part 7, standing traverse to it, to which the hinge arm or fitting part 8 of a standard four-line hinge is attached by two links, the swiveling, cup-shaped part of the hinge arm being joined in the usual way to the upper outer end area of the outer leaf 9 of the folding/sliding door. The outer door leaf 9 is flexibly connected by way of simple hinge joints or a flap hinge 10 to the inner door leaf 11, which is flexibly connected by standard four-link double-link hinges 12 to the side panel 2. The closed position of the folding/sliding door is represented by dashed/dotted lines in FIG. 1.

Figure 7:
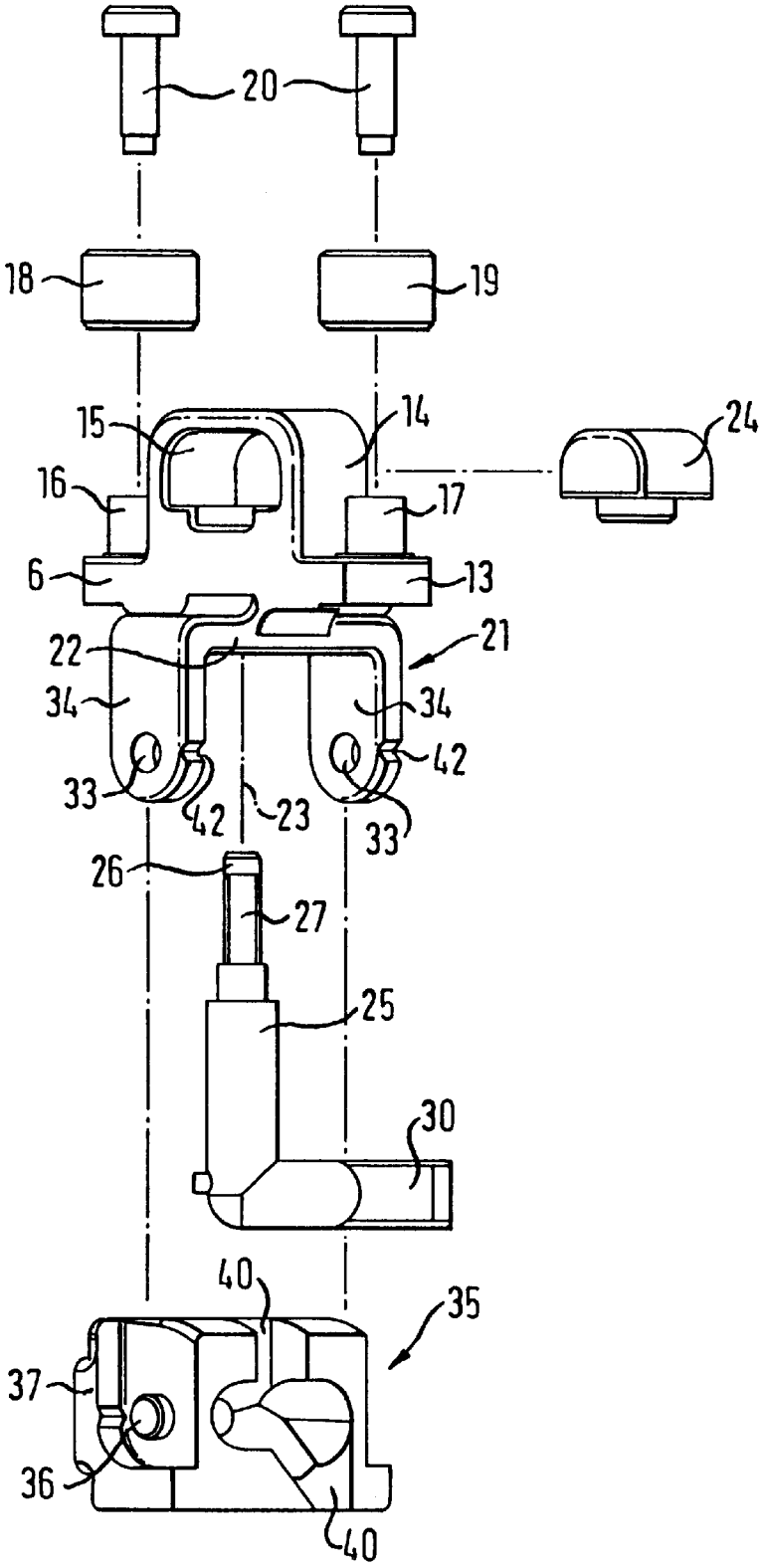
FIG. 7 is a perspective view of the support in accordance with the invention, with its component parts separated.

The support 5 comprises, as best shown in FIG. 7, a carriage part 6 with a lower, plate-shaped part 13. This plate-shaped part has in its center area an approximately square-shaped elevation 14 with rounded top corners and a window-like, transverse-running breakthrough 15. To the side of the square-shaped elevation the plate-shaped part 13 is fitted with protruding bearing journals 16 and 17, on which rollers 18 and 19 are pivot-borne and fixed in place by the headed pins 20 on the bearing journals; the shafts of the pins being secured in the holes in the bearing journals 16 and 17.

The fork-shaped bearing part 21 is joined in one piece to the underside of the plate 13, with the web part 22 of the bearing part standing perpendicular to the plate 13 of the carriage part. The web part 22 and the carriage part 6 are fitted with holes of which the center line is indicated by the dashed/dotted line 23.

Figure 5:
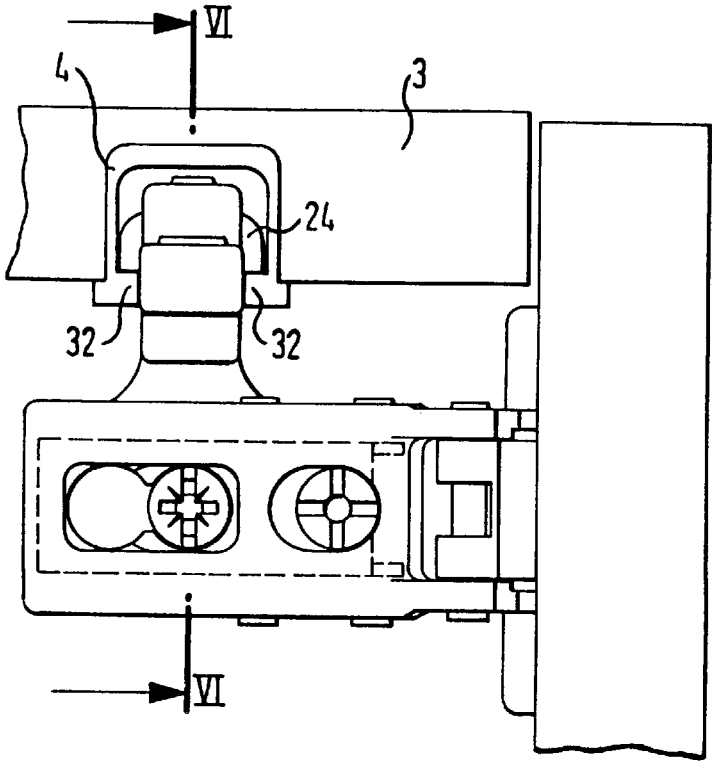
FIG. 5 is a side view of the support guided in the guide channel with the folding/sliding door closed and the furniture body side panel removed.
Figure 6:
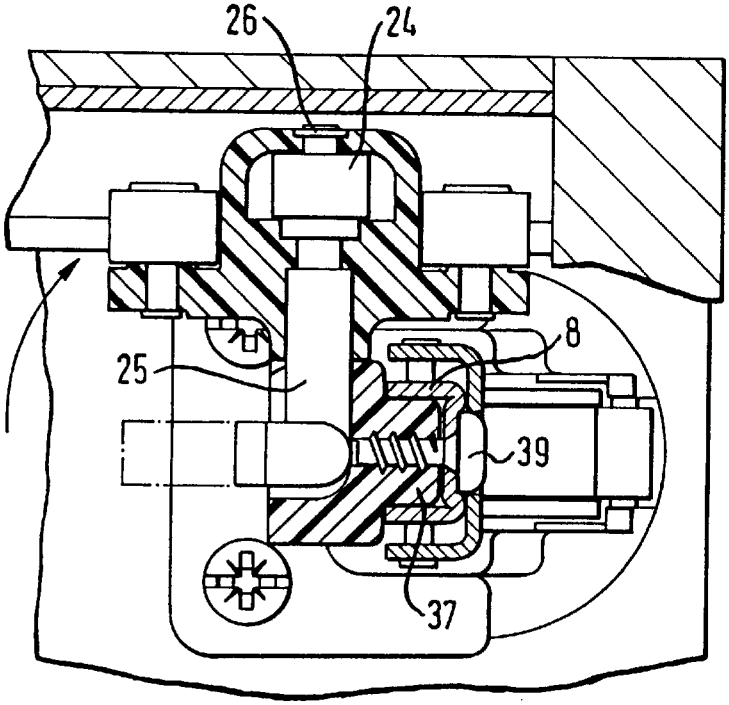
FIG. 6 is a cross-sectional side view of the support taken along line VI—VI in FIG. 5.

In the window-like breakthrough 15 of the square-shaped part 14, the hammer-shaped head 24 is arranged, likewise provided with a through-hole. After insertion of the hammer-shaped head 24 in the window-like breakthrough 15, the pin 25 is fed from the web part 22 through the flush holes and its upper end 26 is riveted in a hole in the upper wall section of the window-like breakthrough, as shown in FIGS. 5 and 6. The pin 25 is fitted with a multi-edged shaft part 27, with which it penetrates the complementary multi-edged hole in the hammer-shaped head 24, so that the head is joined non-flexibly with the pin 25.

The pin 25 is provided with a right-angled part 30 on its bottom end, by means of which the pin is rotatable through 90 degrees such that the hammer-shaped head 24, in one position, is fully within the contour of the square-shaped elevation and, in another position, protrudes with its ends through the window-like breakthrough in the way shown in FIG. 5, such that it is supported by its ends of the inner, horizontal edges of the inward-angled web parts 32 of the guide channel 4, as shown in FIG. 5.

In bearing holes 33 of the arms 34 of the bearing fork 21, the retaining part 7 is flexibly connected by way of side journals 36 joined to the fork which engage in the bearing holes 33. The retaining part 7 is provided on one side with an elongated plinth-like elevation 37 which serves to attach the hinge arm 8 of the hinge joining the support to the door leaf 9. In its center area, the plinth-like elevation 37 is provided with a fixing hole 38 for a screw 39 attaching the hinge arm 8.

On its side opposite the plinth-like elevation 37, the retaining part 7 is provided with recesses 40 for the pin 25 and the angled part 30 of the pin, so that the pin and the angled part do not hinder the swiveling of the retaining part through 90 degrees.

Figure 2:
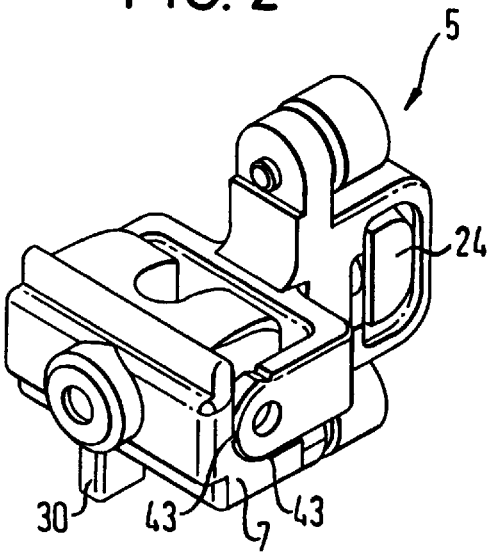
FIG. 2 is a perspective view of the support in accordance with the invention in a position suitable for mounting, but without the hinge arm connecting the support to the outer leaf of a folding/sliding door.

In the pre-fitted position of the support shown in FIG. 2, in which the angled end part 30 of the pin 25 is swiveled into an end position at which the hammer-shaped head 24 is located within the contour of the window-like breakthrough 15, the retaining part 7 clasps the angled part 30 with a ring-like portion of recess 40, so that the pin 25 is locked in a pre-fitting position.

Figure 3:
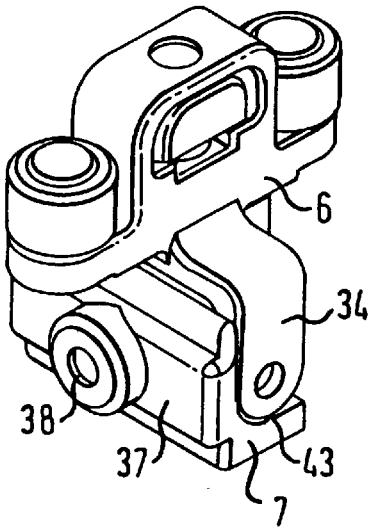
FIG. 3 is a perspective view of the support corresponding to FIG. 2, in which the carriage part is swiveled through 90 degrees relative to the retaining plate for introduction into the guide channel.
Figure 4:
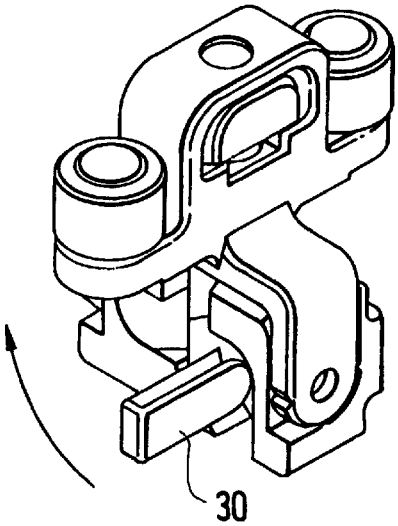
FIG. 4 is a perspective view of the support in its position as per FIG. 3, in which the actuating lever for rotation of the pin supporting the hammer-shaped head is visible.

In the support position shown in FIGS. 3 and 4, the carriage part is swiveled through the longitudinal slot in the guide channel 4 between the angled web parts 32 at the ends. In this position, the angled part 30 and corresponding head 24 can be swiveled through 90 degrees in the center section of the recess 40 so that the ends of head 24 rest on the horizontal edges of the inward-angled web parts 32.

In the arrested position of the hammer-shaped head in the guide channel 4 as shown in FIGS. 5 and 6, the head is frictionally engaged by the pin 25. For additional security, however, the screw 39 may engage on the pin 25 in the way shown in FIG. 6 in order to secure it against rotating.

The rounded faces of the bearing arms 34 are provided with detent recesses 42, into which the detent projections 43 of the retaining part 7 engage at the 90-degree rotated end positions of the pin 25 provided on the sides of recesses in the retaining part.

When the support is mounted, the rollers 18 and 19 of the carriage-shaped part 5 are positioned between the two opposing faces of the angled webs 32 of the guide channel 4, as shown in FIGS. 5 and 6.

The carriage part 6 with moulded-on bearing fork 21, the rollers 18 and 19, the hammer-shaped head 24, and the retaining part 7 are most suitably made of injection-moulded plastic parts.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

I claim:

1. A support for removably attaching a door leaf with a guide channel having arms with inward web parts at ends of the arms forming a C-shaped longitudinal slot, the support comprising:

a carriage part having a hammer-shaped head, the length of the head being substantially greater than the width of the head;

a pin rotatably mounted in the carriage part and engaged with the head for rotating the head about an axis substantially perpendicular to the guide channel to rotatably position the head in an unlocked position such that the length of the head coincides with the longitudinal slot so as to be positionable within the longitudinal slot, and to rotatably position the head in a locked position such that the length of the head is transverse to the longitudinal slot to engage the inward web parts; and, a retaining part engaging the door leaf and rotatably connected to the carriage part for rotation about an axis perpendicular to the pin axis.

2. The support of claim 1, the carriage part further comprising a bearing part having a fork with arms rotatably connected to the retaining part defining the rotatable connection between the carriage part and retaining part.

3. The support of claim 2, wherein the arms are rounded curves with detent recesses that lockably engage with detent projections located on the retaining part.

4. The support of claim 1, wherein the carriage part is rotatably connected with respect to the retaining part from a first position, in which the carriage part is beneath a top of the door leaf, to a second position, in which the carriage part is above the top of the door leaf.

5. The support of claim 1, wherein the pin extends through a hole located in the center of the carriage part and has an angled actuating part, the retaining part further comprising recesses that permit the pin and angled actuating part to rotate with respect to the retaining part and carriage part.

6. Support for a door leaf of a folding/sliding door, comprising:

a longitudinal carriage part which is fitted, in its center area in a C-shaped guide channel, with a hammer-shaped head as a lock mechanism, said head being fixed to a pin to be rotatable around an axis perpendicular to the guide channel, the width of the head being less than, and its length greater than, the width of a longitudinal slot formed between angled webs between arms of the guide channel; and a retaining part rotatably connected to the carriage part by a bearing part and attached to a fitting part carrying the door leaf, and the retaining part is rotatably engaged to the carriage part about an axis running transverse to the carriage part.

7. Support in accordance with claim 6, the bearing part further comprises a bearing fork having arms rotatably connected to the retaining part defining the rotatable connection between the carriage part and retaining part.

8. Support in accordance with claim 7, wherein faces of the arms of the bearing fork are shaped as rounded curves with detent recesses, which interact with complementary detent projections on the retaining part.

9. Support in accordance with claim 7, wherein the pin is arranged in a hole emerging in the center of a web part of the bearing fork and is fitted with an angled actuation part, and that the retaining part is fitted on its side opposite a side serving to attach the fitting part with recesses which permit the carriage part to be swiveled and also permit the pin to be turned by the angled actuating part.

10. Support in accordance with claim 6, wherein the carriage part is rotatable about the transverse axis by substantially 90 degrees between a first position at which the head is within the guide channel and a second position at which the head is outside the guide channel.

* * * * *